US007753722B2

(12) United States Patent
Simonse

(10) Patent No.: US 7,753,722 B2
(45) Date of Patent: Jul. 13, 2010

(54) REFRACTORY MOUNTING UNIT FOR CEILING MOUNTED OR WALL MOUNTED ELECTRIC DEVICES

(75) Inventor: Rens Simonse, Eindhoven (NL)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 12/296,954

(22) PCT Filed: Feb. 15, 2007

(86) PCT No.: PCT/EP2007/051477

§ 371 (c)(1),
(2), (4) Date: Oct. 13, 2008

(87) PCT Pub. No.: WO2008/098618

PCT Pub. Date: Aug. 21, 2008

(65) Prior Publication Data

US 2009/0264013 A1 Oct. 22, 2009

(51) Int. Cl.
*H01R 13/60* (2006.01)

(52) U.S. Cl. ..... 439/537; 439/351; 439/404; 439/953

(58) Field of Classification Search ..... 439/537, 439/313, 334, 351, 361, 658, 953, 659, 404, 439/357

See application file for complete search history.

(56) References Cited

U.S. PATENT DOCUMENTS 1,503,275 A * 7/1924 McFaddin ..... 439/361
3,912,865 A 10/1975 Seebinger
4,810,207 A * 3/1989 Butterfield ..... 439/529
4,952,157 A * 8/1990 Hudson et al. ..... 439/92
6,503,099 B2 * 1/2003 Kerr, Jr. ..... 439/537
7,064,269 B2 * 6/2006 Smith ..... 174/50
7,165,992 B1 * 1/2007 Schiaffino ..... 439/537
2002/0163812 A1 * 11/2002 Tseng ..... 362/404

FOREIGN PATENT DOCUMENTS

| | | |
|---|---|---|
| EP | 0 786 835 | 7/1997 |
| GB | 2 379 094 | 2/2003 |
| WO | 2006/050754 | 5/2006 |

* cited by examiner

*Primary Examiner*—Michael C Zarroli
(74) *Attorney, Agent, or Firm*—Michael J. Striker

(57) ABSTRACT

The present invention relates to a refractory mounting unit for ceiling mounted or wall mounted electric devices and comprises: a refractory housing (1) having at least one wall and an inner and an outer side; the at least one wall comprising one section (9), in which internal contacts (6) are directed to an inner side of the housing (1), external contacts (7) are directed to an outer side of the housing (1) and a line-through (8) is integrated as part of the at least one wall for electrically interconnecting the internal contacts and external contacts (7), a plug (2) having a side being form-closed to the one section (9) of the at least one wall at the outer side of the housing (1), the side comprising contacts (12) for contacting the external contacts (7) of the housing (1), and a clamp (3) for clamping the plug (2) against the one section of the at least one wall.

8 Claims, 4 Drawing Sheets

REFRACTORY MOUNTING UNIT FOR CEILING MOUNTED OR WALL MOUNTED ELECTRIC DEVICES

STATE OF THE ART

The present invention pertains to a refractory mounting unit for in-ceiling mounted or wall mounted electric devices, in particular for ceiling mounted loudspeakers.

Loudspeakers are frequently used in public buildings for information or entertainment purposes. Such information systems are known from WO 2006/050754.

The loudspeakers are mounted commonly in or on the ceiling of corridors or rooms. Openings, in which the loudspeakers are inserted, are provided in the ceiling. The wiring of the loudspeakers is provided via cable ducts between the ceiling and the next floor above of the building.

In particular in buildings for public use the ceilings are part of a fire protection. Hence, the openings in the ceilings ought to be sealed in a refractory manner.

DISCLOSURE OF THE INVENTION

The refractory mounting unit for electric devices can be placed into fitting openings in walls and seals the opening completely with its refractory housing.

According to an aspect of the invention a refractory mounting unit for ceiling mounted or wall mounted electric devices comprises:

a refractory housing having at least one wall and an inner and an outer side; the at least one wall comprising one section, in which internal contacts are directed to an inner side of the housing, external contacts are directed to an outer side of the housing and a line-through is integrated as part of the at least one wall for electrically interconnecting the internal contacts and external contacts, a plug having a side being form-closed to the one section of the at least one wall at the outer side of the housing, the side comprising contacts for contacting the external contacts of the housing, and a clamp for clamping the plug against the one section of the at least one wall.

The inventive refractory mounting allows an easy installation. The cabling including the plugs can be finished in for instance a cable duct. The refractory housings are mounted in the ceiling later on and contacted to the cabling via the plugs. The plugs are fixed to the housings via the clamp.

According to a preferred embodiment the one section of the at least one wall can be made of a ceramic. The line-through can be formed as internal wirings embedded into the ceramic.

According to an embodiment the plug has further sides additional to the side comprising the contacts and further contacts for connecting cables are arranged on the further sides, and the clamp is provided with strain reliefs arranged at a position opposite to the further contacts, when the clamp clamps the plug against the one section of the at least one wall. The further sides are preferable vertically arranged to the side providing the contacts. The strain reliefs integrated in the clamp allow fixing the cables before the moment the plug is fitted to the refractory housing.

The strain reliefs may comprise barbs for inhibiting a pulling of a cable away from the further contacts.

The strain reliefs may be provided with a cable clamp for clamping a cable.

The clamp may be provided with snap-fits and the housing may be provided with attachment points corresponding to the snap-fits.

The external contacts of the housing and the contacts of the plug may be one of female and male, wherein each contact of the external contacts of the housing and each corresponding contact of the contacts of the plug are of opposite type.

The electric device can be a loudspeaker and the loudspeaker may be connected to the internal contacts of the housing.

BRIEF DESCRIPTION OF THE DRAWINGS

The present invention will be explained exemplarily based on preferred embodiments and the following figures.

EMBODIMENTS OF THE INVENTION

Figure 1:
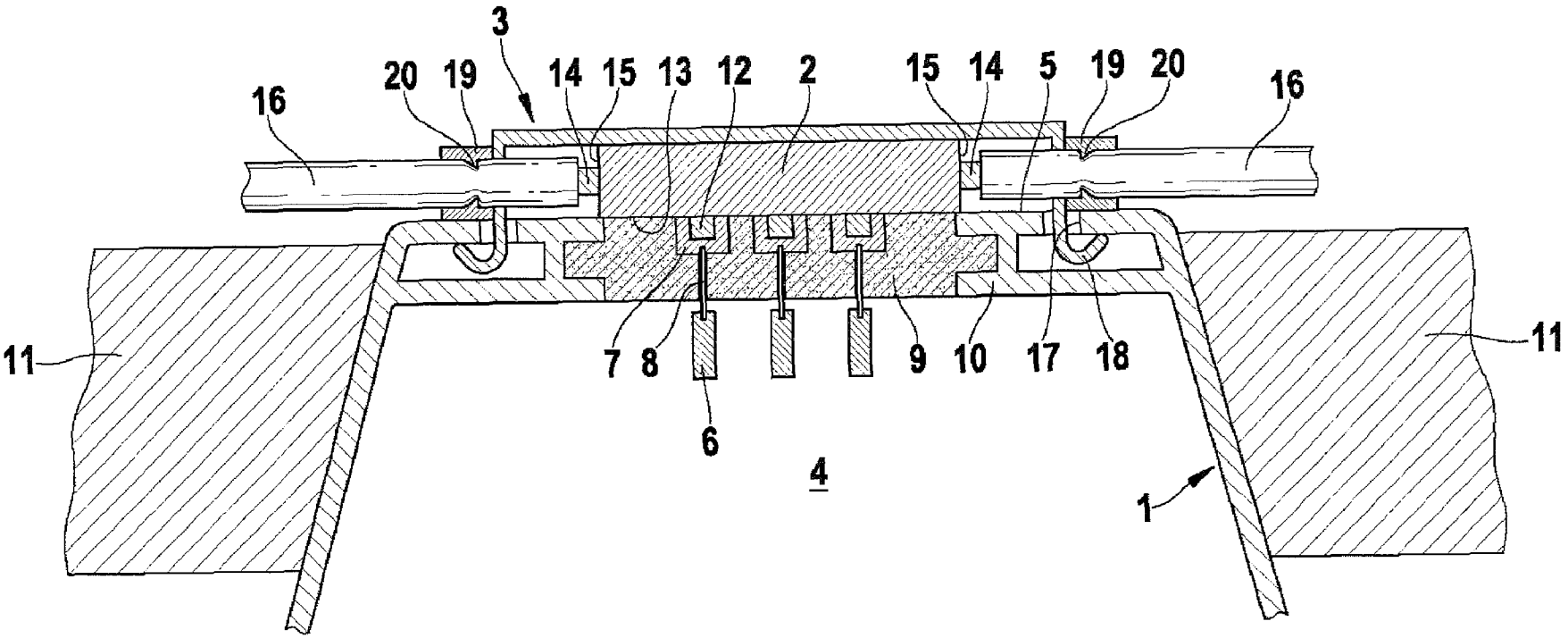
FIG. 1 shows a cross section of a refractory mounting.
Figure 2:
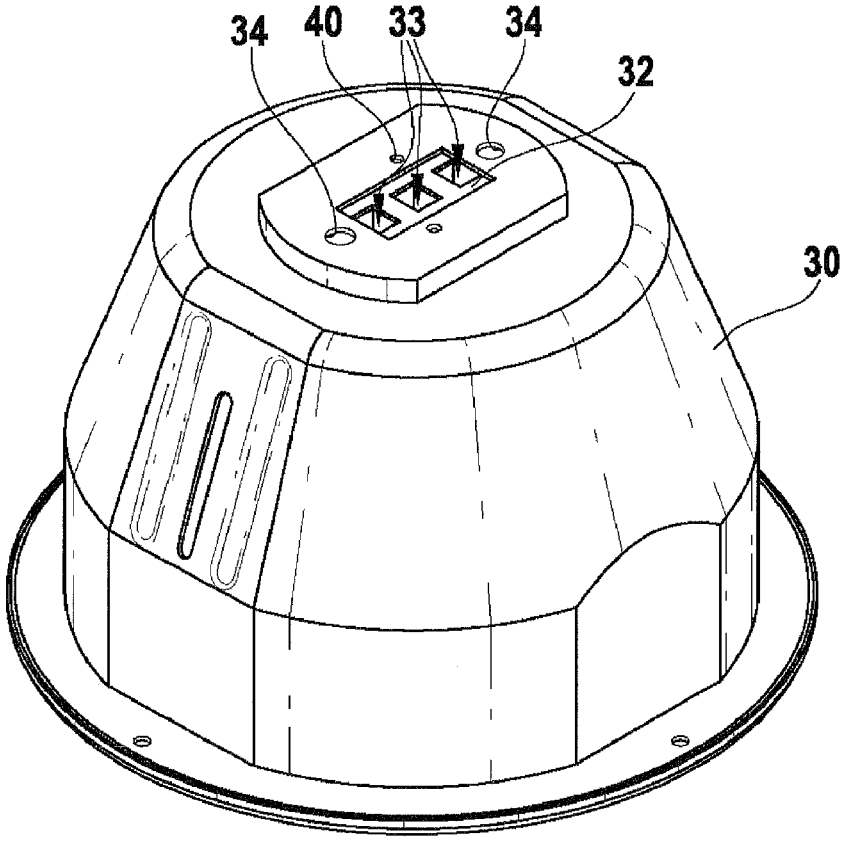
FIG. 2 shows a perspective view on the housing of a refractory mounting.

FIG. 1 shows an exemplary embodiment of a refractory or fire resistant mounting. The mounting may be used for a loudspeaker or any other electric device.

The refractory mounting is made of three parts: a housing 1, a plug 2 and a clamp 3. The housing 1 is preferably made of a metal, preferably steel or a ceramic. It may be formed of a fire inhibiting or flame resistant synthetics. The outer shape of the housing 1 can be cylindrical, calotte-shaped or any form suitable for an electric device to be placed within the housing 1. The housing 1 can comprise a lid (not shown) to close the housing 1. The housing 1 has an inner side 4 and an outer side 5.

Internal contacts 6 for providing electric signals or supply to devices are provided within the inner side 4 of the housing 1. The internal contacts 6 are connected to external contacts 7 that are provided at the outer side 5 of the housing. Preferably the external contacts 7 are of a female type as shown in FIG. 1. The internal contacts 6 can be of any type or simple wires which may be bonded or soldered to an electric device. The interconnection between the internal contacts 6 and the external contacts 7 is provided via line-throughs 8 arranged in the ceramic part 9 of the housing 1.

The line-throughs 8 are embedded in a ceramic section 9 of the housing 1. In case the other parts of the housing 1 are made of a metal the ceramic part 9 is formed as an inlet arranged in the wall. Mechanical supporting structures 10 can hold the ceramic inlet 9 in place.

The housing 1 can be placed into an opening within a wall or ceiling 11 as illustrated in FIG. 1.

The plug 2 comprises contacts 12 which are formed to match the external contacts 7 of the housing 1. The outer shape of the plug, in particular of its facet 13 with the contacts 12 is form closed to the ceramic part 9. A reliable electric connection between the plug 2 and the housing 1 is thus performed.

The plug 2 is provided with supply contacts 14. The supply contacts 14 are preferably arranged at the vertical side walls 15 of the plug 2, i.e. with respect to the facet 13. Internal connections within the plug 2 provide a connection of the supply contacts 14 and the contacts 12. Each contact 12 is at least contacted to one supply contact 14. It may be advantageous to provide supply contacts 14 on opposing sides 15 and internally interconnect the supply contacts 14 on both sides. A wiring 16 can be continued through the plug 2.

The clamp 3 fixes the plug 2 against the housing 1. The housing 1 can provide lock elements, e.g. openings 17 for snap-fits 18 of the clamp.

Strain reliefs 19 are provided on the clamp 3. They are arranged opposing the supply contacts 14. The purpose of the strain reliefs 19 is to hold the supply lines 16 in place and prevent the supply lines to detach from the plug 2. The strain reliefs 19 may comprise barbs 20 directed inwards to the plug 2. The strain reliefs 19 may have an inner diameter exactly fitting the outer diameter of the cables 16 or of slightly smaller inner diameter.

FIGS. 2 to 6 show a second embodiment of the refractory mounting. The refractory mounting may be used as a fire dome. A housing 30 is made of steel. The housing 30 is provided with a top surface 31. A ceramic inlet 32 is inserted into the top surface 31. The ceramic inlet 32 is form fitted to the housing 30 such that the top surface 31 is sealed.

The ceramic inlet 32 contains female electric contacts 33. The spacing between the female electric contacts 33 may be different. The number of three female electric contacts is not limiting. In an example the fire dome is used fire sensors, smoke sensors, etc. These devices require three lines and, hence, three electric contacts.

Figure 3:
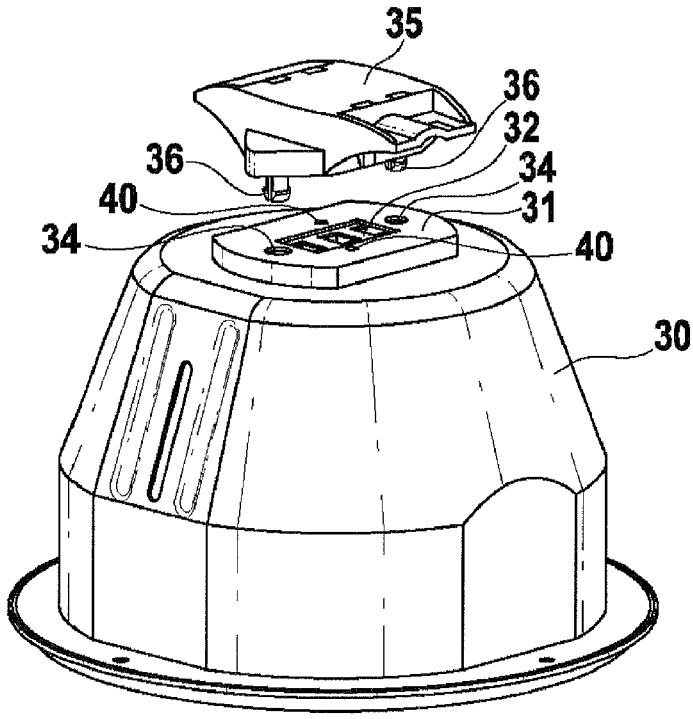
FIG. 3 shows an exploded view of the housing of FIG. 2 and a plug.

The ceramic inlet 31 or the top surface 31 of the housing 30 is provided with fixing holes 34. The form or arrangement of the fixing holes 34 is chosen such that a clamp 35 can be connected to the female electric contacts 33 and fixed by the fixing holes 34 only in one orientation (FIG. 3). The clamp 35 is provided with snap fits 36 which can be inserted into the fixing holes 34. Additionally, holes 40 or stubs may be arranged on the top surface 31 of the housing 30, the clamp 35, and/or a plug to secure the correct orientation of the clamp 35 and the plug with respect to the housing 30.

Figure 4:
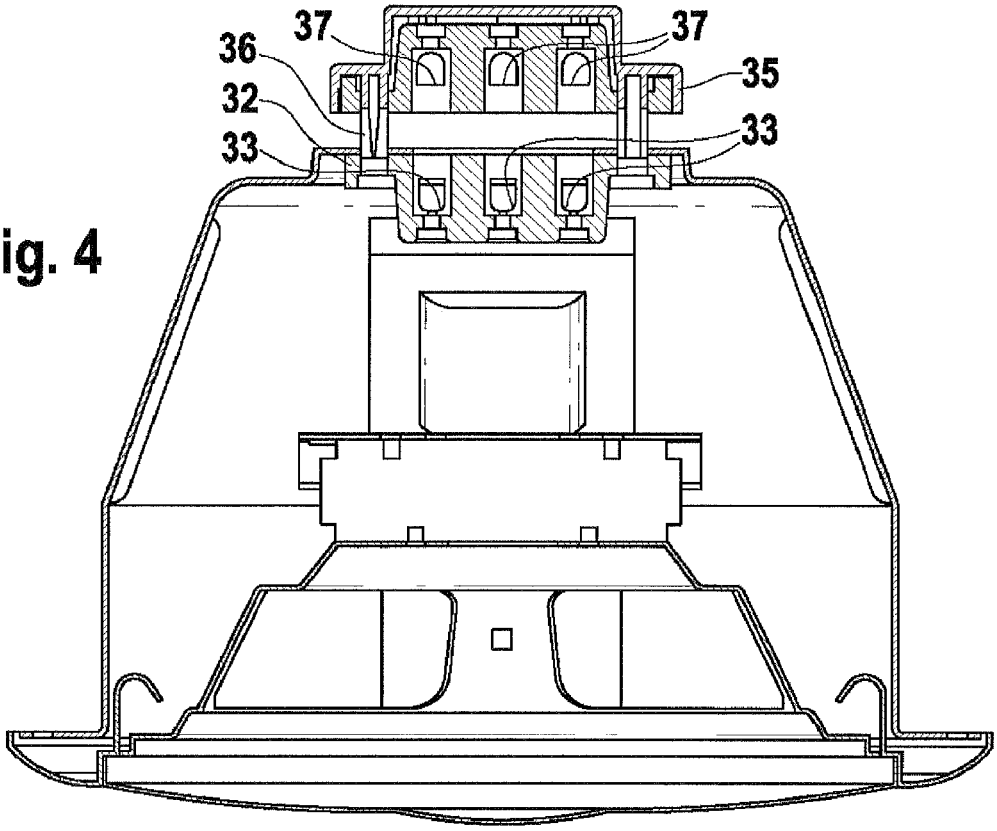
FIG. 4 shows a cross section of FIG. 3.
Figure 5:
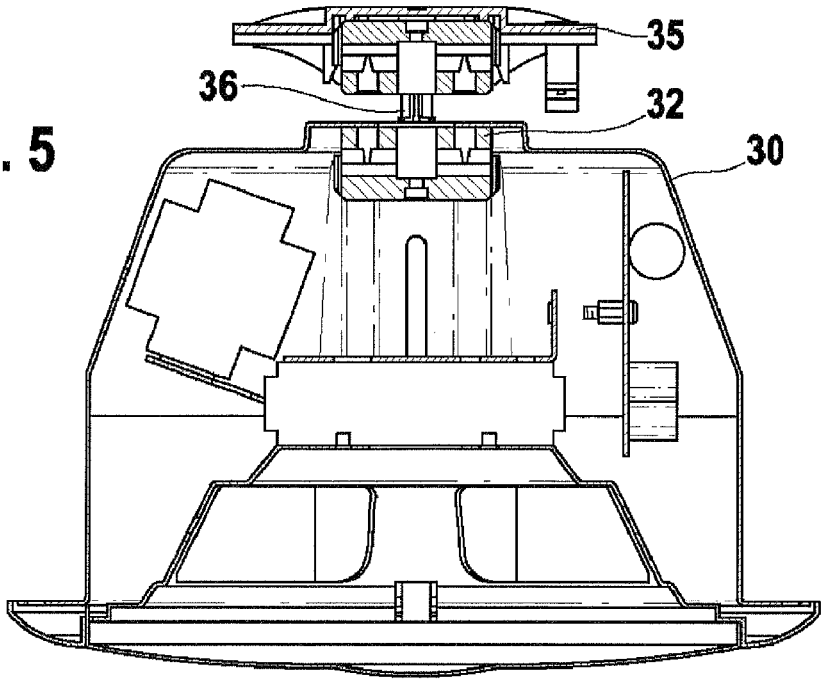
FIG. 5 shows a second cross section of FIG. 3.

FIGS. 4 and 5 show cross sections of the clamp 35 and the housing 30. The clamp 35 is not yet fixed to the housing 30.

Figure 6:
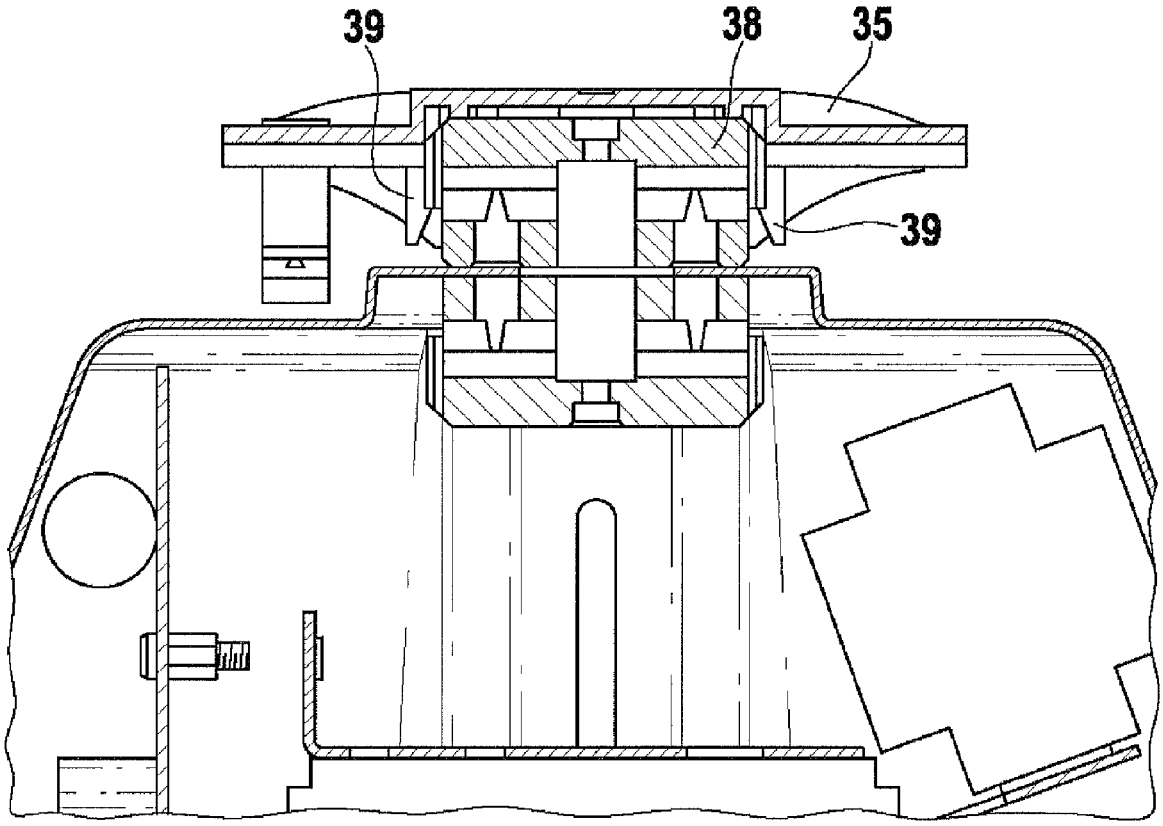
FIG. 6 shows a cross section of the refractory mounting.

The female electric contacts 33 are opposing male electric contacts 37 arranged in the clamp 35. The male electric contacts 37 are part of a plug 38 (FIG. 6). The plug 38 is snapped into the clamp 35 by clips 39. The plug 38 can be formed of the same material as the ceramic inlet 32. The ceramic inlet 32 and the plug 38 can be even formed equally, just having electric contacts of opposing types arranged inside.

The invention claimed is:

1. A refractory mounting unit for ceiling mounted or wall mounted electric devices, comprising a refractory housing (1) having at least one wall and an inner (4) side and an outer side (5);

the at least one wall comprising one section (9), in which internal contacts (6) are directed to an inner side (4) of the housing (1), external contacts (7) are directed and extend to an outer side (5) of the housing (1) and a line-through (8) is integrated as part of the at least one wall for electrically interconnecting the internal contacts (6) and external contacts (7); and a plug (2) having a side (13) being form-closed to the one section (9) of the at least one wall at the outer side (5) of the housing (1), the side (13) comprising contacts (12) for contacting the external contacts (7) of the housing (1), and a clamp (3) for clamping the plug (1) against the one section (9) of the at least one wall;

wherein said refractory housing is configured such that upon secure mounting in an opening within the wall or the ceiling, said opening is sealed effectively separating said inner side (4) from said outer side (5).

2. The refractory mounting unit according to claim 1, wherein the one section (9) of the at least one wall is made of a ceramic.

3. The refractory mounting unit according to claim 1, wherein the plug (2) has further sides (15) additional to the side (13) comprising the contacts (12) and wherein further contacts (14) for connecting cables (16) are arranged on the further sides (15), and the clamp (3) is provided with strain reliefs (19) arranged at a position opposite to the further contacts (14), when the clamp (3) clamps the plug (2) against the one section (9) of the at least one wall.

4. The refractory mounting unit according to claim 3, wherein the strain reliefs (19) comprise barbs for inhibiting a pulling of a cable (16) away from the further contacts (19).

5. The refractory mounting unit according to claim 3, wherein the strain reliefs are (19) provided with a cable clamp for clamping a cable.

6. The refractory mounting unit according to claim 1, wherein the clamp (3) is provided with snap-fits (18) and the housing (1) is provided with attachment points (17) corresponding to the snap-fits.

7. The refractory mounting unit according to claim 1, wherein the external contacts (7) of the housing (1) and the contacts (12) of the plug (2) are one of female and male, and wherein said female and male contacts are configured to electrically interconnect in a cooperating manner.

8. The refractory mounting unit according to claim 1, wherein the electric device is a loudspeaker and the loudspeaker is connected to the internal contacts of the housing.

* * * * *